US009821593B2

(12) United States Patent
Ruhland-Bauer et al.

(10) Patent No.: US 9,821,593 B2
(45) Date of Patent: Nov. 21, 2017

(54) RELIEFED CARD-SHAPED DATA CARRIER

(71) Applicant: GIESECKE & DEVRIENT GMBH, Munich (DE)

(72) Inventors: Michael Ruhland-Bauer, Staig (DE); Harald Reiner, Munich (DE); Thanh-Hao Huynh, Bruckmuhl (DE); Karlheinz Mayer, Grunenbach (DE)

(73) Assignee: GIESECKE+DEVRIENT MOBILE SECURITY GMBH, Munich (DE)

( * ) Notice: Subject to any disclaimer, the term of this patent is extended or adjusted under 35 U.S.C. 154(b) by 12 days.

(21) Appl. No.: 14/759,022

(22) PCT Filed: Dec. 20, 2013

(86) PCT No.: PCT/EP2013/003926

§ 371 (c)(1),
(2) Date: Jul. 2, 2015

(87) PCT Pub. No.: WO2014/108164

PCT Pub. Date: Jul. 17, 2014

(65) Prior Publication Data

US 2015/0367669 A1 Dec. 24, 2015
US 2016/0185151 A2 Jun. 30, 2016

(30) Foreign Application Priority Data

Jan. 14, 2013 (DE) ..... 10 2013 000 556

(51) Int. Cl.
*B42D 25/324* (2014.01)
*B42D 25/328* (2014.01)
(Continued)

(52) U.S. Cl.
CPC ..... *B42D 25/328* (2014.10); *B42D 25/29* (2014.10); *B42D 25/324* (2014.10); *B42D 25/425* (2014.10); *Y10T 156/1039* (2015.01)

(58) Field of Classification Search
CPC ... B42D 25/324; B42D 25/425; B42D 25/328
See application file for complete search history.

(56) References Cited

U.S. PATENT DOCUMENTS 4,988,126 A 1/1991 Heckenkamp et al.
5,267,753 A * 12/1993 Chock ..... B42D 25/29 283/54

(Continued)

FOREIGN PATENT DOCUMENTS

CH EP 1580020 A1 * 9/2005 ..... B42D 25/29
DE 4441198 A1 5/1996

(Continued)

OTHER PUBLICATIONS

German Examination Report for corresponding German Application No. 102013000556.6, dated Oct. 11, 2013.

(Continued)

*Primary Examiner* — Kyle Grabowski
(74) *Attorney, Agent, or Firm* — Workman Nydegger

(57) ABSTRACT

A multilayer card-shaped data carrier has a core layer based on paper, with an individualization formed in the layer. At least a part of the area of the data carrier is deformed into a relief which has a viewing angle-dependent optical effect and which extends into the core layer through the cover layer.

8 Claims, 4 Drawing Sheets

(51) Int. Cl.
*B42D 25/425* (2014.01)
*B42D 25/29* (2014.01)

(56) References Cited

U.S. PATENT DOCUMENTS

| | | | | |
|---|---|---|---|---|
| 5,433,807 | A | 7/1995 | Heckenkamp et al. | |
| 8,137,899 | B1 * | 3/2012 | Muller | B42D 25/425 283/72 |
| 8,875,628 | B2 | 11/2014 | Depta et al. | |
| 2005/0072326 | A1 * | 4/2005 | Braun | B42D 25/29 101/170 |
| 2005/0240549 | A1 * | 10/2005 | Adamczyk | B42D 25/29 |
| 2006/0107854 | A1 * | 5/2006 | Bauer | B42D 25/00 101/170 |
| 2008/0250954 | A1 * | 10/2008 | Depta | B42D 25/29 283/87 |
| 2009/0237795 | A1 * | 9/2009 | Koivukunnas | B44B 5/026 359/566 |
| 2010/0108874 | A1 | 5/2010 | Zahedi | |
| 2014/0232100 | A1 | 8/2014 | Mayer et al. | |

FOREIGN PATENT DOCUMENTS

| | | | | |
|---|---|---|---|---|
| DE | WO 0220280 | A1 * | 3/2002 | B42D 25/425 |
| DE | 102005025095 | A1 | 12/2006 | |
| DE | 102007024298 | B3 | 10/2008 | |
| DE | 102009004128 | A1 | 7/2010 | |
| DE | 102011108239 | A1 | 1/2013 | |
| EP | 0318717 | A2 | 6/1989 | |
| EP | 0323108 | A2 | 7/1989 | |
| EP | 2173567 | B1 | 9/2011 | |
| WO | 03022598 | A1 | 3/2003 | |
| WO | 2013045055 | A1 | 4/2013 | |

OTHER PUBLICATIONS

International Preliminary Report on Patentability for corresponding International PCT Application PCT/EP2013/003926, dated Jul. 14, 2015.

International Search Report for corresponding International PCT Application PCT/EP2013/003926, dated Jun. 4, 2014.

* cited by examiner

RELIEFED CARD-SHAPED DATA CARRIER

BACKGROUND

This invention relates to a multilayer card-shaped data carrier having a core layer made of paper, and carrying an individualization by which it is associated with a person or an institution. In particular, the invention relates to payment cards, e.g. credit cards or bank cards, admission tickets, identification cards or data pages for passport booklets.

Particularly with cards individualized for persons or institutions, there is always the desire to secure them against forgery or tampering of any kind It is to be ensured that only authorized persons or institutions can manufacture and issue such identification cards.

WO 03/022598 A1 discloses for this purpose a card-shaped data carrier built up of a plurality of plastic layers, which carries on an inner layer a security element that can only be forged with great effort. In the cover layer located above the inner layer, a lenticular lens structure is moreover formed exactly over the security element. The domes of the lenticular lens structure rise above the surface and form elevated ribs. The lenticular lens structure produces a viewing angle-dependent optical effect. Depending on the configuration of the lenticular lens structure one can achieve different effects. There can be achieved, inter alia, the effect of an apparent motion or a color effect.

EP 323 108 A2 further discloses a multilayer card-shaped data carrier in the form of a security card whose upper side is configured as a lenticular lens structure over the full area. The lenticular lens structure here is so arranged that an individualization applied on an inner layer is recognizable only from a certain viewing angle.

DE 10 2009 004 128 A1 shows a data carrier which is based on a multilayer composite containing at least one paper layer. The data carrier is printed and furnished by embossing with a relief which, together with the print, produces a viewing angle-dependent effect. Printing and embossing can be carried out in an arbitrary order. In a variant, embossing-through is utilized as a security feature. This solution can be combined with holograms or other diffractive structures.

DE 44 41 198 A1 describes a card having a card body into whose upper side a lens structure is embossed. The lens structure thereby penetrates a lacquer layer applied to the upper side.

WO 2013/045055 A1 and EP 2173567 B1 disclose embossing in paper layers to manufacture security elements showing an optically variable effect.

The known solutions considerably increase the degree of difficulty in imitating accordingly equipped data carriers. However, they are suited primarily for plastic buildups. With multilayer buildups whose core layer is a paper layer, they do not offer any effective protection against attacks directed to separating the layer buildup in the paper layer. One known attack here consists in removing the cover layer together with any security elements located thereon, e.g. a lenticular lens structure, from the paper layer. If this succeeds, it becomes possible to tamper with individualizations, e.g. a statement of name or address, applied on the paper layer and now exposed. The previously detached cover layer together with its security elements can be re-applied to the tampered-with data carrier, so as to retain the security functions originally present.

SUMMARY

It is the object of the invention to provide a data carrier having a paper-based core layer, which is more difficult to tamper with.

The data carrier according to the invention provides an effective mechanical separation protection between a cover layer having security elements and a paper-based core layer furnished with an individualization. At the same time, there is advantageously provided a further security element which is visually verifiable without auxiliary means. Through the invention there is created a connection between the cover layer having the security elements and the paper core layer furnished with an individualization, which cannot be separated reversibly. Upon a separation, the individualization is at least partly irreversibly destroyed, or the cover layer having the security elements is so impaired that a reconnection with a previously detached paper layer is immediately recognizable, or the paper core layer tears at some places upon separation, giving rise to an uneven separation surface that is easily recognizable upon recombination with another paper layer. This is obtained by deforming at least a part of the surface of the data carrier by embossing into a relief which extends into the core layer and which nearly punches through the core layer preferably at some places. The relief is embossed in from the cover side or from the back side and can include security elements present on the upper side.

In a preferred embodiment, the structure depth of the relief is relatively great in terms of the total thickness of the data carrier and can correspond thereto, i.e. the structure depth can correspond to up to 100% of the total thickness of the undeformed data carrier.

The relief furthermore preferably has a viewing angle-dependent optical effect which superimposes the pattern or motif formed by the relief such that both the relief and the viewing angle-dependent optical effect are recognizable. Preferably, it carries, independently of the individualization and the security elements present, an information item proper to it, which becomes visible in an optical effect proper to the relief. Expediently, the effect consists in the relief producing a different visual impression from different viewing angles. In particular, it can be provided that a first information item is visible from a first viewing angle, and a second information item from a second viewing angle. In an expedient embodiment, the relief includes in a targeted manner a part of the individualization. As a result of the thereby effectuated relatively strong deformation of the individualization, it is impossible or in any case considerably more difficult to cleanly expose the individualization in the relief region by separating the cover layer from the paper layer.

It has been surprisingly ascertained that the individualization remains well recognizable in spite of the comparatively strong impairment through the relief formation.

Especially expediently, the core layer consists of paper and the individualization is realized in the form of an ink jet print or by a thermal transfer process.

The relief is advantageously realized as an embossed print. In an advantageous embodiment, the relief has height differences and structure widths of up to 200 μm; expediently, the height differences amount to up to 100 μm, especially expediently up to 80 μm. The relief embossing can be effected in some embodiments such that it not only includes the cover layer and the core layer, but continues into the protective layer on the underside, so that the relief is also perceptible in a weakened form on the underside of the data carrier.

In an advantageous embodiment, it is provided that together with the relief there are simultaneously produced in the data carrier other embossed structures which show other optical effects. This is preferably effected with a single embossing stamp in which all or at least a plurality of embossed structures are simultaneously formed. In an expedient embodiment, it is provided that the embossing stamp possesses the same size as the data carrier. In a particularly expedient embodiment, the cover layer has a thickness of 1 to 10 μm, and the core layer a thickness of 50 to 200 μm.

BRIEF DESCRIPTION OF THE DRAWINGS

With reference to the drawing, an exemplary embodiment of the invention will hereinafter be explained more closely. There are shown.

DETAILED DESCRIPTION OF VARIOUS EMBODIMENTS

Figure 1:
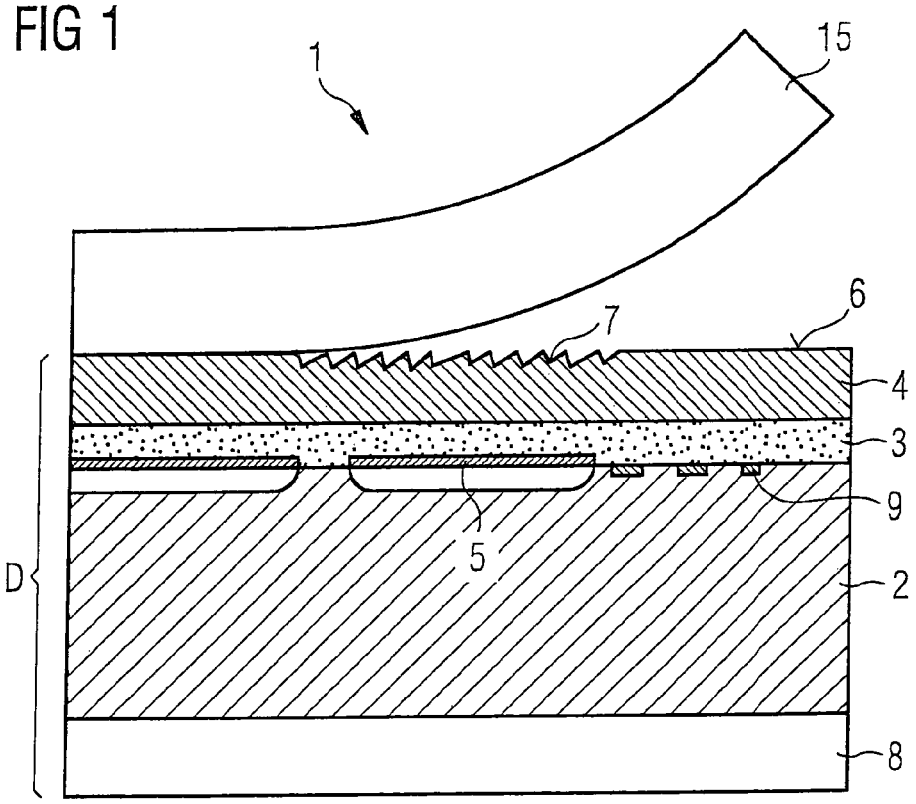
FIG. 1 a cross section through a data carrier before the deformation is performed, FIG. 2 a cross section through a data carrier after incorporation of a relief, FIG. 3 a perspective view of a data carrier with a relief having a viewing angle-dependent optical effect, FIG. 4 a configuration of substructures for producing a superimposed optically variable effect, and FIGS. 5*a* & 5*b* further configurations of substructures for producing a superimposed optically variable effect.

FIG. 1 shows in a representation that is not true to scale—which also applies to the other figures—a cross section through a card-shaped multilayer data carrier 1 before a relief 10 is formed. The data carrier 1 can be e.g. a data page for a passport booklet, an identification card, an admission ticket, a credit card or a bank card. It comprises in the representation of FIG. 1 a core layer 2, a superjacent connection layer 3, thereon a cover layer 4 on the upper side, and a protective layer 8 on the underside; the terms "upper side" and "underside" also employed hereinafter relate only to the figures and are to be understood as relative. On the core layer 2 a background design print layer 9 is formed on the upper side toward the connection layer 3. Above the design print layer 9 an individualization 5 is further applied. On the upper side 6 of the cover layer 4, which also forms the upper side of the finished data carrier 1, a security element 7 is is configured in the form of an optically variable element. For a part of the production phase a carrier layer 15 is further located on the cover layer 4.

The buildup represented in FIG. 1 is understood to be the simplest possible basic buildup. All shown layers 2, 3, 4 and 8 can in practical embodiments also be configured in the form of a plurality of single layers. The protective layer 8 on the underside can also be omitted in some embodiments. Further, there can be provided further layers with additional functions, for example a textile layer placed between core layer 2 and cover layer 4 for stabilizing the buildup of the data carrier 1.

The core layer 2 preferably consists of paper or is based on paper. The paper can contain additives, e.g. security substances. It typically possesses in practical embodiments a thickness of 70 to 200 μm, preferably 90 to 150 μm, particularly preferably 100 to 130 μm. On its upper side the core layer 2 is frequently furnished with a background design print layer 9 which covers the total area of the data carrier 1 or at least the greatest part thereof. The design print layer 9 is hard to imitate and also forms a security feature besides its optical effect.

The connection layer 3 is a transparent or semi-transparent adhesive foil which consists e.g. of a hot-melt material. It possesses a thickness of 1 to 10 μm, expediently 3 to 8 μm.

The cover layer 4 is likewise transparent or semi-transparent and is expediently based on an embossing lacquer. It is dimensionally stable under temperatures and pressures occurring upon lamination and has a thickness of 10 to 40 μm, preferably 20 to 30 μm. The optically variable element 7 is preferably a diffractive surface relief, e.g. a hologram, or a Kinegram. Expediently, the cover layer 4 is configured to be lustrous, i.e. it shows a regular reflection. In the cover layer 4 further security elements can be formed.

The connection layer 3 and the cover layer 4 with the optically variable element 7 pre-formed therein are supplied not necessarily, but expediently, together as a preliminary product on a carrier layer 15. The carrier layer 15 expediently consists of plastic and possesses a thickness of 30 to 100 μm; it is detachable from the cover layer 4 after lamination and is removed.

The protective layer 8 on the underside is preferably realized as an opaque or transparent plastic layer, e.g. of polycarbonate or PET. It expediently possesses a thickness of 50 to 300 μm. In some embodiments, the protective layer 8 on the underside is realized as a decorative layer and carries individualizing information, security elements and/or decorative elements proper thereto. The protective layer 8 on the underside is in principle optional and can also be omitted.

The overall data carrier 1 typically possesses—without the carrier layer 15—a thickness D of 100 to 300 μm, preferably 120 to 180 μm.

The individualization 5 is formed on the upper-side surface of the core layer 2 toward the upper side 6. It is so formed that it is optically recognizable through cover layer 4 and connection layer 3. The individualization 5 comprises e.g. statements of address or name, individual identification numbers, the rendition of handwritten signatures or photos.

The formation of the individualization 5 is effected before the connection layer 3 and the cover layer 4 are applied. As indicated in FIG. 1, the individualization 5 can penetrate partly into the core layer 2. Expediently, the individualization 5 is realized in the form of an ink jet print or transferred by a thermal transfer process. However, other methods for individualization are likewise possible.

Figure 2:
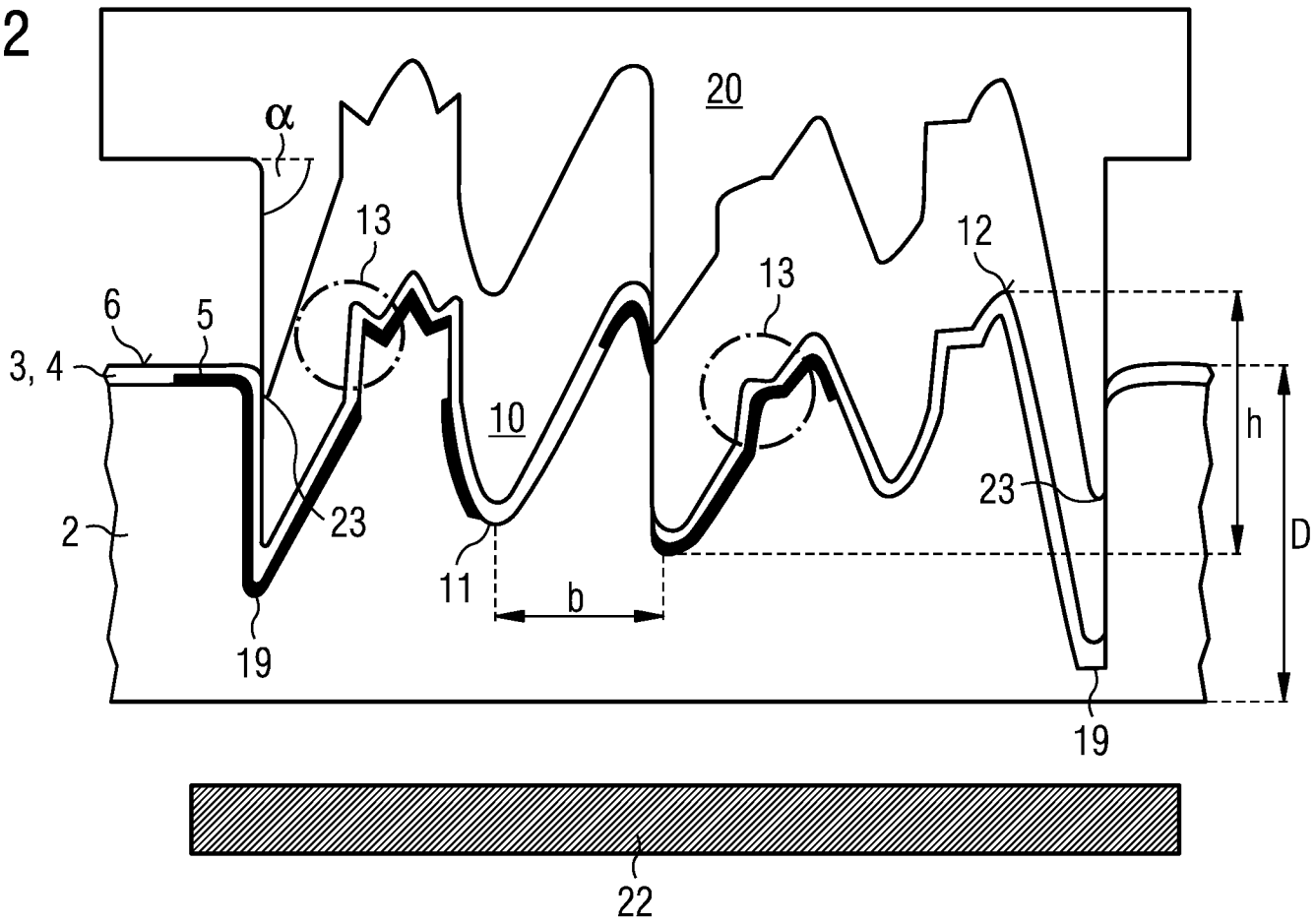

In a part of the data carrier 1 there is formed on the upper side 6 a relief 10 with a three-dimensional structure. This is illustrated in FIG. 2.

The formation of the relief 10 is expediently effected after the data carrier 1 has been individualized, the connection layer 3 and the cover layer 4 applied, and the carrier layer 15 removed.

In a variant, the formation of the relief 10 is effected before the removal of the carrier layer 15, e.g. during a laminating operation for applying the cover layer 4.

The relief 10 is tactilely perceptible. Its three-dimensional structure is moreover such that it additionally produces an optically variable effect that depends on the viewing angle. The optically variable effect superimposes the relief 10, which shows for example a wavy pattern. Expediently, the viewing angle-dependent optical effect consists in the representation of two different information items which become visible from different viewing angles. For example, the optical effect consists in the providing of viewing angle-dependent alphanumeric and/or graphical information. In a preferred embodiment, the information formed in the relief 10 is so configured that a first alphanumeric information item or first graphical pattern is recognizable from a first viewing angle, and a second alphanumeric information item or second graphical pattern from a second viewing angle. The additional optically variable effect produced by the relief 10 also superimposes the effect of the optically variable element 7 formed in the cover layer 4. The two are perceptible simultaneously or independently of each other, depending on the embodiment.

The relief 10 is formed, in an expedient embodiment, in a region of the data carrier 1 where no individualization 5 is located. The superficial extent of the relief 10 is chosen accordingly. Expediently, the chosen region is specially prepared, e.g. by imprinting a suitable ground color instead of the design print 9 or thereover. The ground color is preferably a metallically lustrous, reflective color, e.g. a gold or silver color. In a variant, a metallization can also be formed on the underside of the cover layer 4. In an expedient embodiment, a security element 7 can further be located in the chosen region.

In another expedient embodiment, which is also indicated in FIG. 2, there is chosen for the relief 10 a region of the data carrier 1 where a part of the individualization 5 is also located. In this case there is preferably chosen a region where there are located parts of an image or an alphanumeric individualization information item in which the average line thickness of the individual characters is greater than the structure depth of the relief 10; for an identification card one can choose e.g. a statement of the period of validity. If the relief 10 includes the individualization 5, the included part is deformed as well in accordance with the relief 10.

The formation of the relief 10 is effected by means of an embossing tool. Said tool expediently consists of an embossing stamp 20 and a counterpressure element 22, as indicated in FIG. 2. The embossing stamp 20 carries on its surface a negative 21 of the relief 10 to be manufactured; the counterpressure element 22 is expediently a plane area. To obtain especially good embossing results, the counterpressure element 22 can moreover be configured to be compressible.

The negative 21 of the relief 10 to be manufactured that is formed on the surface of the embossing stamp 20 is so configured that it is transferable to the data carrier 1 in an embossing operation with high quality. It accordingly has no undercuts, and the structures are so shaped that the produced relief 10 has no breakdowns. The negative 21 possesses depressions and elevations which, upon embossing, produce in the surface of the data carrier 1 corresponding elevations/depressions with lowest points 11 and highest points 12, whose height difference can lie in the order of magnitude of the thickness of the core layer 2. The produced lowest points 11 and highest points 12 expediently form a pattern or motif that is recognizable to the naked eye and has a three-dimensional appearance, its nature being different from the adjacent upper side 6. The pattern can be for example a groove pattern with a sawtooth profile, or a wavy pattern.

Expediently, the negative 21 possesses at least one peak structure 23 protruding beyond the elevations and depressions, which, upon embossing, penetrates into the core layer 2 over more than 66% and thus nearly punches through it. Although a complete punch-through is normally not actually present, the counterform 19 that is produced by the peak structure 23 in the relief 10 will nevertheless hereinafter be designated as a punch-through. At least one flank of the peak structure 23 is moreover realized with a steep flank angle a of 70° to 90°, relative to the upper side 6. This causes the core layer 2 to tear at these places upon an attempt to separate it, so that an even separation over the total area is no longer possible.

The negative 21 further possesses structure elements which produce in the relief 10 substructures 13 which influence the reflection behavior of the relief 10 and produce an optically variable effect which superimposes the pattern formed by the relief 10. The substructures 13 are formed on the flanks of the elevations/depressions. The substructures 13 are small in comparison to the height differences between lowest points 11 and highest points 12.

Figure 4:
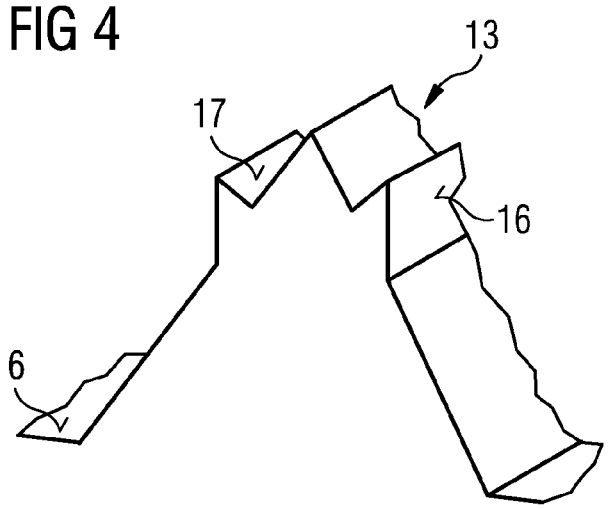

FIG. 4 shows an enlarged perspective view of an example of a configuration of the substructures 13 formed in the relief 10. There are formed out of the flanks of the elevation/depression on both sides two pyramid-shaped or prism-shaped substructures 13 which are small in comparison to the structure depth of the relief 10. The substructures 13 respectively have a first flank 16 which is aligned approximately perpendicularly to the upper side 6, and a second flank 17 which is aligned parallel or nearly parallel to the opposing flank of the elevation/depression. Reflection of the light impinging on the differently inclined flanks 16, 17 of the substructures 13 into different angle ranges results in a tilt effect.

Figure 5A:
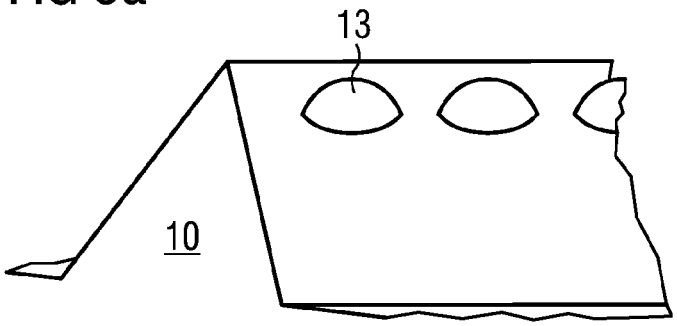
Figure 5B:
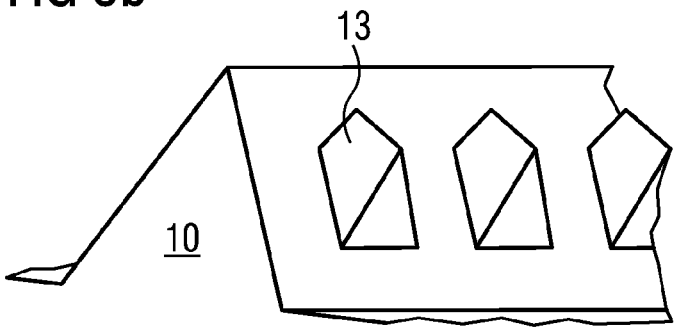

Another example of a configuration of the substructures 13 is shown in FIG. 5. The substructures 13 consist here of dormer-like structures which are respectively formed out of a flank of the elevation/depression. The substructures 13 can be configured for example as a quadrant of a sphere or as a quarter ellipse, as indicated in FIG. 5*a*, with arbitrary other sectors or parts of a sphere or ellipse also being possible. Or they can have the shape of a gable roof, as indicated in FIG. 5*b*, which projects from the elevation/depression. The principal axes of the substructures 13 can be disposed in arbitrary angular positions relative to the longitudinal axis of the elevation/depression.

Further embodiments and information about the configuration of the substructures 13 can be found in the prints WO 2013/045055 A1 and EP 2173567 B1, whose contents are expressly incorporated herein in this regard.

In an expedient embodiment, at least some of the elevations and depressions of the negative 21 are configured in a targeted manner as sharp and steep structures with flank angles a of 70° to 90°which, in the embossing operation, produce at least in certain places a punching effect which leads to breakdowns of the cover layer 4. The cover layer defects are intended here. They additionally impede the separability of the core layer 2 and the cover layer 4, or the possibility of rejoining layer parts as in the initial state once they have been separated.

With the embossing tool 20, 22 the relief 10 is embossed into the data carrier 1 from the upper side 6 by pressure. In so doing, there are produced, on the one hand, depressions 11 whose lowest points lie up to 100 μm, expediently 30 to 50 μm, below the level of the upper side 6 of the undeformed data carrier 1. On the other hand, there are produced highest points 12 which protrude equally far beyond the level of the upper side 6 of the undeformed data carrier 1. In relation to the total thickness D of the data carrier 1 in the undeformed state, the structure depth h of the relief 10 therefore amounts to up to 100%, i.e. it amounts to up to 200 μm in the exemplary embodiments considered here. Typically, it lies between 10 and 100 μm, especially expediently between 10 and 80 μm. The average structure width b of the relief 10 is expediently slightly below the order of magnitude of the structure depth h and amounts to about three quarters thereof, i.e. the structure width b expediently amounts to up to 150 μm; especially expediently, it is between 10 and 70 μm. However, greater structure widths b of up to 300 μm are likewise possible.

On the punch-throughs 19 the distance of the lowest points 11 from the level of the undeformed data carrier 1 amounts to more than half of the thickness of the data carrier. Expediently, the residual material thickness on the punch-throughs amounts to 33% to 0%, preferably 70% and 90%, of the thickness D of the data carrier 1. On the punch-throughs 19 the core layer 2 is therefore nearly cut through. In relation to the exemplary embodiments, this means that on the punch-throughs 19 the lowest points lie 100 to 200 μm, preferably 140 to 180 μm, below the level of the undeformed data carrier 1.

The embossing operation for manufacturing the relief 10 can be effected at ambient temperature. However, it is preferably effected at an elevated temperature of 50 to 200° C., preferably at 80 to 140° C. The pressure is in principle so chosen that the deformation does not lead to breakdowns in the cover layer 4 or in the core layer 2; suitable pressures lie e.g. at 0.1 to 1.0 t/cm$^2$, corresponding to approx. 1 to 10 MN/m$^2$. In some cases, deformation-induced breakdowns in the cover layer 4 can also be intended, however, in order to further increase the security against attempts at separation. In such cases, higher pressures can also be considered.

Preferably, the deformation for forming the relief is effected such that on the far side of the data carrier 1, i.e. on the side of the lower protective layer 8, the relief 10 is no longer perceptible and the underside of the data carrier 1 instead remains smooth. This is obtained by the counter-pressure element.

In another embodiment, the deformation of the data carrier 1 in the region of the relief 10 is effected such that it also continues into the protective layer 8 on the underside at least in a weakened form. At least the existence of the relief 10 is thereby still perceptible tactilely on the far side of the data carrier 1.

Figure 3:
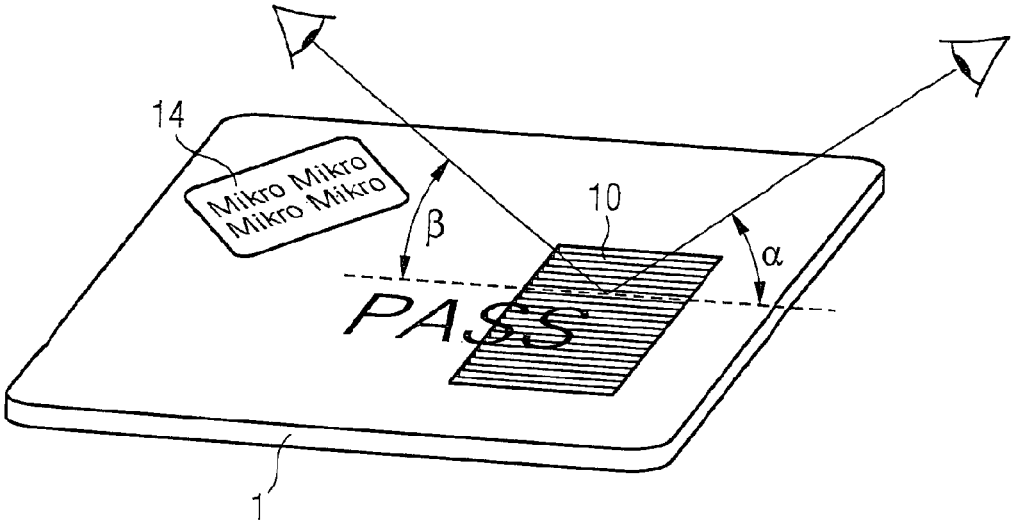

In an especially expedient embodiment, it is provided that the embossing tool 20, 22 possesses the same or a similar size as the data carrier 1. There can then be formed in other partial regions of the data carrier 1, simultaneously with the relief 10, further embossed structures 14 which have other structure depths and structure widths and produce other physical or optical effects. For example, there can be formed in another partial region of the data carrier 1 a microlens structure (having microlenses with a diameter of e.g. less than 50 μm), a matt structure or a blaze grating, as are known e.g. from the prior art reported at the outset. Or a microprint 14 can be embossed in another partial region, as indicated in FIG. 3. Through the thus possible simultaneous manufacture of different embossed structures 10, 14 in only one embossing operation, it is achieved that all embossed structures 10, 14 are placed in an exactly defined relation to each other.

FIG. 3 shows by way of example a data page for a passport booklet in which a relief 10 and at the same time a microprint structure 14 are formed. The relief 10 superimposes a part of the individualization 5. From the plan-view angle a oriented along the longitudinal axis of the data page in the example of FIG. 3 a different information item is visible to a viewer than from the plan-view angle β. Other angles and angular orientations are of course readily possible.

While retaining the basic idea, namely, to emboss a relief into a partial region of a data carrier that is furnished with an individualization, the invention permits a number of further appropriate embodiments which are not individually described here. Thus, there is some leeway for example with respect to the materials of the layers. Individual layers can in particular have additional items provided therein, e.g. security elements, or they can be subjected to a preceding special processing. The embossing tool can, in further embodiments, also contain embossed elements purely for design reasons, such as a frame enclosing the embossed region. Also, it can be provided that, simultaneously with the reliefs, the embossing tool produces cut-throughs, e.g. in the form of slots or holes, at pre-specified places of the data carrier. It is further readily possible to configure the viewing angle-dependent optical effect such that more than two different information items become visible from more than two different viewing angles.

LIST OF REFERENCE SIGNS

1 Data carrier
2 Core layer
3 Connection layer
4 Cover layer
5 Individualization
6 Upper side of cover layer
7 Security element
8 Protective layer
9 Background design print layer
10 Relief
11 Lowest points
12 Highest points
13 Substructures
14 Embossed structures
15 Carrier layer
16 First flank
17 Second flank
18
19 Punch-through
20 Embossing stamp
21 Negative
22 Counterpressure element
23 Peak structure

The invention claimed is:

1. A multilayer card-shaped data carrier having at least one core layer and at least one cover layer, wherein at least a part of the area of the data carrier is deformed into a relief which additionally has a superimposed viewing angle-dependent optical effect that is additional to and superimposed over an individualization that is included in the core layer, wherein the individualization is separated from the relief by an intermediary connection layer positioned between the relief and the core layer, wherein the relief extends at least partially into the core layer through the cover layer, the structure depth of the relief being at least 20% of the total thickness of the data carrier, but less than 100% of the thickness of the data carrier and wherein the relief has at least one punch-through on which the residual material thickness of the core layer amounts to between 33% and 0%.

2. The data carrier according to claim 1, wherein the core layer is based on paper.

3. The data carrier according to claim 1, wherein the relief is produced by an embossed print.

4. The data carrier according to claim 1, wherein the cover layer carries in the region of the relief an optically variable element which is deformed in accordance with the relief.

5. The data carrier according to claim 1, wherein it has a protective layer on the opposing side of the cover layer, and the deformation also includes the protective layer.

6. The data carrier according to claim 1, wherein another part of its area is likewise deformed into a relief whose structure depth is different from that of the relief and has another optical effect.

7. A method for manufacturing a multilayer card-shaped data carrier having a core layer and a cover layer having the steps of:

supplying a core layer based on paper;

supplying a cover layer;

forming an individualization in the core layer and/or in the cover layer;

connecting the cover layer with the core layer; and deforming at least a part of the area of the cover layer and of the core layer into a relief which additionally has a superimposed viewing angle-dependent optical effect that is additional to and superimposed over an individualization that is included in the core layer, wherein the individualization is separated from the relief by an intermediary connection layer positioned between the relief and the core layer, wherein the relief extends at least partially into the core layer through the cover layer, the structure depth of the relief being at least 20% of the total thickness of the data carrier, but less than 100% of the thickness of the data carrier and wherein the core layer is embossed upon deforming at least at one place up to a residual material thickness of 33% to 0%, based on the thickness of the data carrier.

8. The method according to claim 7, wherein the connection of core layer and cover layer is effected by lamination, and the deformation into a relief happens upon the laminating operation.

* * * * *